United States Patent [19]

Mulvey

[11] 4,140,442

[45] Feb. 20, 1979

[54] HIGH PRESSURE PUMP

[75] Inventor: Philip A. Mulvey, Elmhurst, Ill.

[73] Assignee: Perfect Pump Co., Inc., Elmhurst, Ill.

[21] Appl. No.: 777,139

[22] Filed: Mar. 14, 1977

[51] Int. Cl.[2] ..... F04B 39/14

[52] U.S. Cl. ..... 417/454; 92/156; 92/168; 137/454.4; 137/543.17; 417/569

[58] Field of Search ..... 417/454, 536; 137/454.4, 454.6, 543.17, 543.19; 123/198 DA, 198 P, 195 C; 184/6.5; 92/156, 168

[56] References Cited

U.S. PATENT DOCUMENTS

| | | | |
|---|---|---|---|
| 2,016,390 | 10/1935 | Richardson | 137/543.19 |
| 3,367,277 | 2/1968 | Andrews et al. | 92/257 |
| 3,687,231 | 8/1972 | Scheiterlein | 184/6.5 |
| 3,744,936 | 7/1973 | Sadler | 417/536 |
| 3,830,255 | 8/1974 | Freiheit | 137/543.19 |
| 3,849,032 | 11/1974 | Mulvey et al. | 417/454 |
| 3,878,861 | 4/1975 | Pareja | 137/543.17 |
| 3,879,013 | 4/1975 | Hajek, Jr. | 137/543.19 |

*Primary Examiner*—C. J. Husar

*Attorney, Agent, or Firm*—Knechtel, Valentino, Demeur & Dallas

[57] ABSTRACT

There is disclosed an improved high pressure pump which includes an improved valve system wherein each of the valve assemblies includes a valve housing having a cup-shaped chamber surrounded by an apertured side-wall, an apertured top wall and a defined open bottom wall, the valve housing further including a peripheral continuous flange carried on the bottom end thereof and extending for a short distance outwardly from the valve housing and having a continuous side edge on an outer surface thereof, the outer surface of the continuous flange provided with a continuous shoulder spaced distance inwardly from the side edge of the flange and bounding the defined open bottom wall of the valve housing, and the valve assembly being completed by a valve cap positioned in arrested arrangement within the valve housing and adapted for reciprocating movement such that the valve cap alternately opens and closes the open bottom wall, and further characterized in that the valve housing including the cup-shaped chamber, the peripheral continuous flange and the continuous shoulder are formed integrally as a one-piece construction. An additional feature of the invention is the provision of a two part plunger arrangement which includes a crank case plunger suction having an inner end for connection to the crank shaft and an outer end including locking means associated therewith, and an outer pump plunger section having an inner end for matingly locking with the outer end of the crank case plunger, and an outer opposed pusher end for contacting the fluid to be pressurized and pumped. The plunger arrangement is further characterized in that locking means are provided for lockingly engaging the crank case plunger section with the pump plunger section in order to permit the removable engagement therebetween.

9 Claims, 9 Drawing Figures

FIG. 1
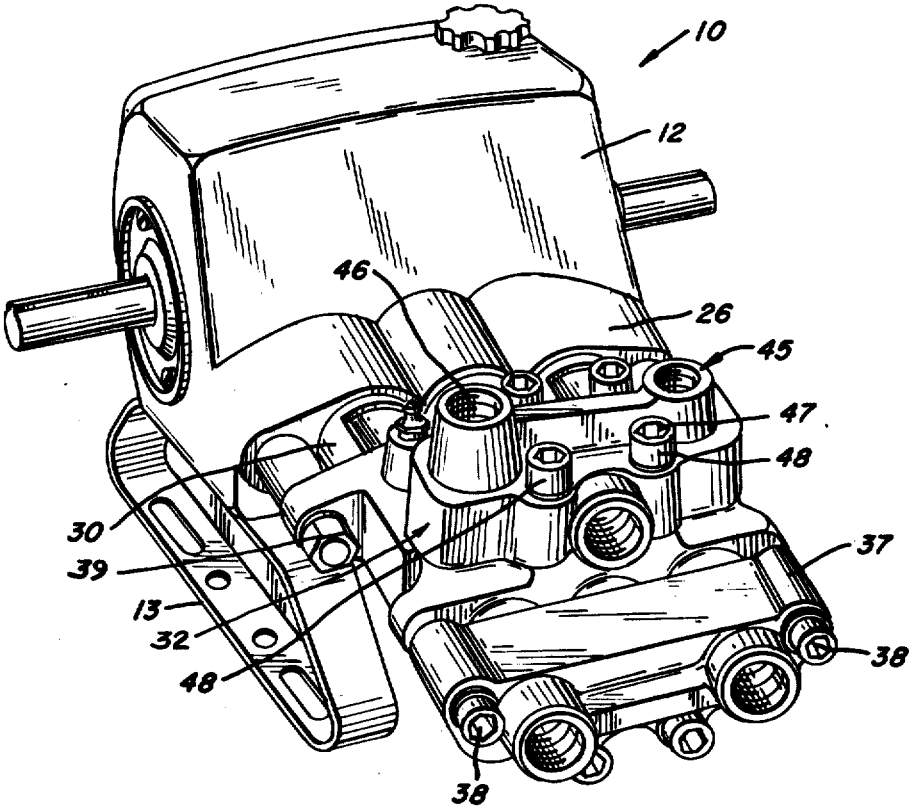
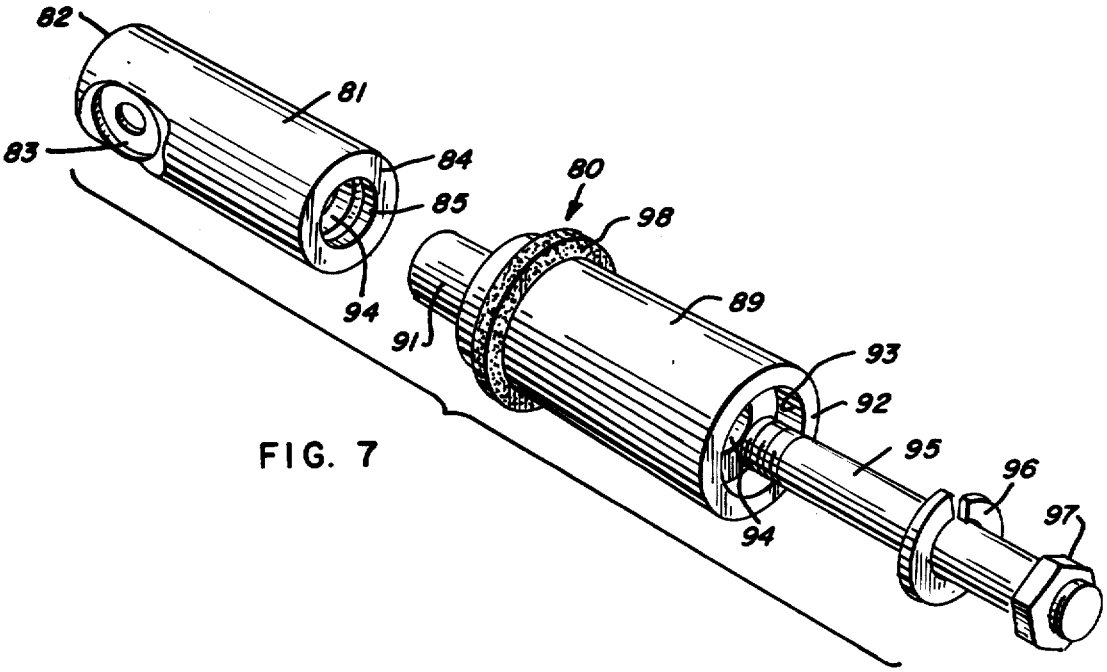
FIG. 7

FIG. 5
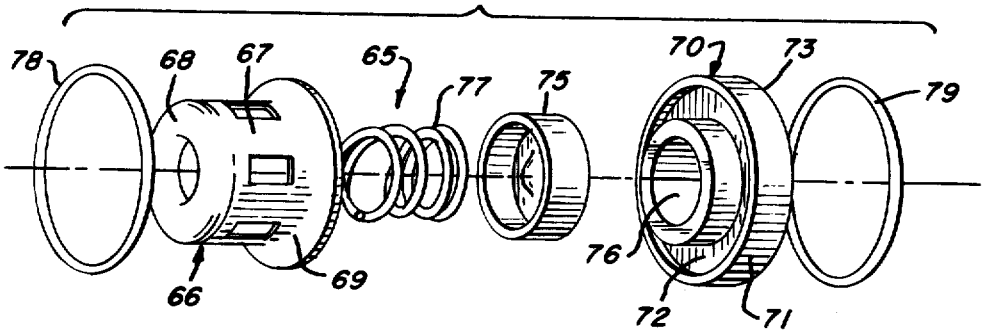
FIG. 4
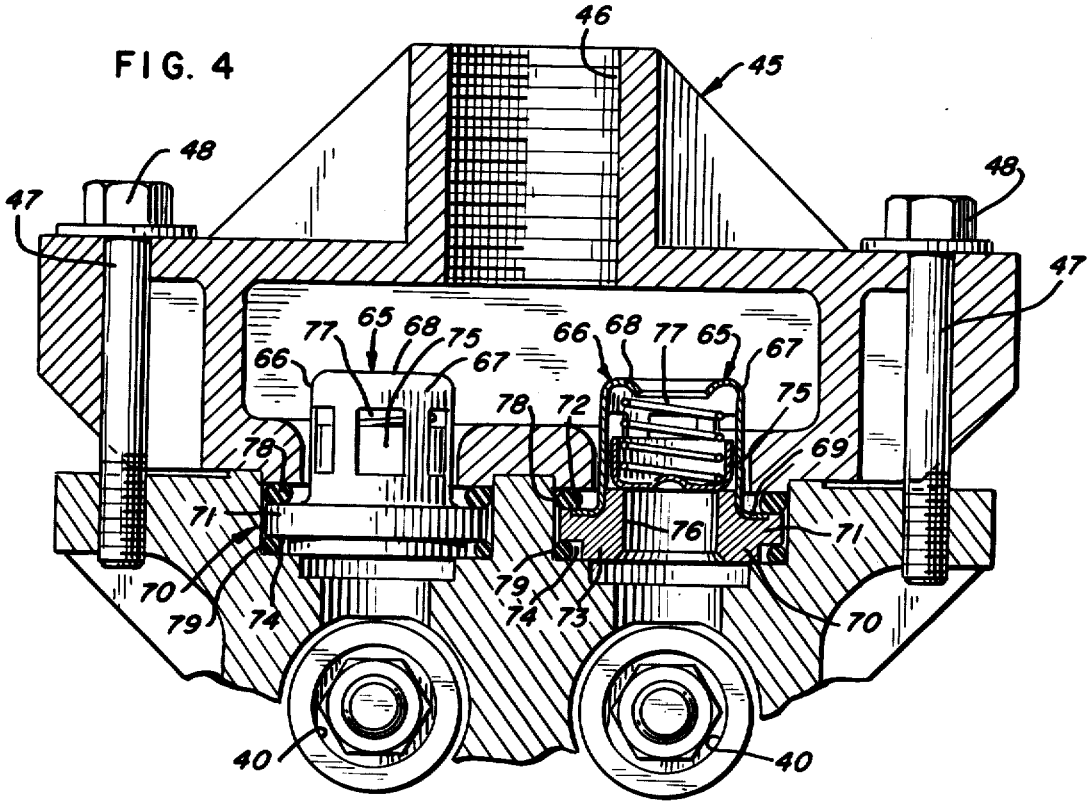
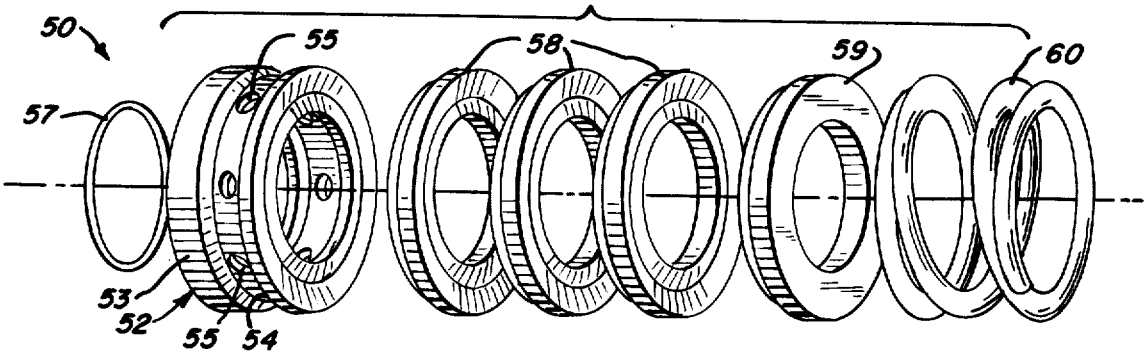
FIG. 6

HIGH PRESSURE PUMP

BACKGROUND OF THE INVENTION

The subject matter of the present invention is related to U.S. Pat. No. 3,849,032 which is similarly directed to a high pressure reciprocating pump and which is owned by the assignee of the present invention. The present invention pertains to various improvements directed to components of the high pressure pump described therein and as will be more fully described hereinafter.

High pressure pumps of the type disclosed herein are particularly useful for application such as car wash operations, or any other similar operation where it is desired to discharge a fluid such as water at a relatively high pressure. It will be appreciated that most such operations involve a cleaning process where the pressure of the fluid discharged from the pump is intended to perform a cleaning function by relying upon the pressure of the fluid ejected from the pump. It will therefore be appreciated that it is desirable to provide a high pressure pump which incorporates components having the ability to withstand high fluid pressures in order to function efficienty. It has been found to be further desirable to provide a high pressure pump wherein the various components will have a long useful life in order to minimize the down time of the machinery with the attendant cost of repairs.

As will be noted from a review of Pat. No. 3,849,032, the high pressure pump described therein provided an improved valve assembly in that the valve construction was formed by a valve housing having a valve cap positioned therein and seating against a valve seat formed as a separate element, that is, separate from the valve housing. The construction of the valve assembly was essentially completed by providing an annular elastomeric seal and an anchoring ring, as separate elements, the elastomeric seal overlying and maintaining the valve housing and valve seat in position. The valve seat, in turn, in use, is placed in a approproiate entry or discharge port, the annular elastomeric seal functioning to frictionally position the valve assembly in position. It will therefore be appreciated that the valve assembly as described in U.S. Pat. No. 3,849,032 is intended as a basic three part construction, the three parts basically including the valve housing, the valve seat, and the annular elastomeric seal.

It was found however, that upon prolonged use of the high pressure pump, the elastomeric seal would peel back or extrude and cause a floating of the valve assembly within the corresponding port. This would, in turn, cause leaking through the valve assembly and necessitate that the pump be torn apart for the purpose of replacing the valve assembly in order provide a tighter elastomeric seal to firmly position the valve assembly within the appropriate port. Hence, while the valve assembly as described therein achieved an improved construction at the time, it has now been found to be desirable to further improve the valve assembly in order to achieve a much improved and longer lasting pump assembly.

It was further found that additional improvements could be effected over the pump shown in U.S. Pat. No. 3,849,032 in order to further improve the life of the pump as well as the efficiency thereof. In this connection, it was found that the plunger generally associated with high pressure pumps such as the type described above generally provide a solid cylindrical plunger which reciprocates within the cylindrical chamber. A packing system is provided in such pumps which include a grease ring associated with a grease fitting so that grease may be applied to the packing with the attendant result that the plunger would be lubricated during the reciprocating movement thereof. While this was found to be reasonably efficient, nevertheless, in view of some of the usages of such pumps, the plunger has a tendency to wear due to the abrasive materials which are carried by the fluid being pushed through the pump. For example, where such pumps are used in a car wash assembly, the fluid employed is water, and usually, detergent materials are used with the water. During periods of prolonged non-use, the detergent has a tendency to settle out of the fluid and return to granular form. Hence, any fluid existing in the cylindrical cylinder containing the plunger will contain a fair quantity of particlized detergent. When the pump is then reactivated, as the plunger reciprocates through the packing system, the abrasive materials have a tendency to score and deteriorate the outer surface of the plunger. This, in turn, will ultimately cause fluid to leak through the packing system and may ultimately find its way into the crank case. Leaks of this type require that the pump be dismantled with a view toward changing the plunger in order to provide a plunger having a smooth and integral surface to eliminate such types of leaks.

It was further noted that in order to change the ratio of incoming fluid to discharge fluid, an entirely different pump was necessary. For example, a pump designed to discharge six gallons of fluid per minute, would have a particular plunger diameter and in order to vary that discharge rate, a pump having a different plunger diameter must be substituted therefor. Hence, it has been found that by changing the plunger arrangement, and specifically, by providing a two-piece plunger as opposed to a one-piece plunger, not only can the wet end of the plunger be easily replaced in the event of an abraded surface, but also, one can vary the diameter of the wet end portion of the plunger without at the same time requiring that the pump be replaced, or that the entire plunger be removed in order to fit either a larger or a smaller diameter plunger. Hence, it has been found that additional improvements can be made with regard to the plunger assembly culminating in an overall more efficient pump assembly.

Another area where some difficulties have been found relate to the crank case housing and the manner in which the same is drained. The prior art devices as exemplified by U.S. Pat. No. 3,849,032 generally provide a crank case housing wherein the internal portion of the housing sits relatively parallel to an underlying support surface such that the bottom wall is reasonably flat. Drain holes are positioned in either the side walls or the back wall of the housing and fitted with a drain plug which may be removed in order to remove the sludge and oil from the crank case in order to replace the same with fresh oil. While theoretically this arrangement should operate efficiently, nevertheless it has been found that crank case oil often contains a great deal of heavy sludge which is more solid than liquid, and hence, upon draining the fluid from the crank case, a good portion of the sludge will not normally drain from the crank case housing by natural gravity flow. Hence, as the lubricating oil is replenished constantly, a greater degree of sludge is left behind in the crank case, until utilimately, the build-up of sludge causes problems with the crank shaft. The present invention provides an improved construction of the crank case housing, which in combination with the other features to be described more fully hereinafter, provides a high pressure pump which has a manifestly longer useful life than heretofore possible in the past.

In connection with the provision of a packing system, it has also been the practice to provide a packing system which includes a base V-ring which is interposed between the plurality of annular packing rings, and the coil spring which butts against the forward wall of the cylindrical chamber. Generally, such base V-rings are formed of an elastomeric material, and it has been found that various problems arise because of this construction. For example, generally the coil spring which is provided has a final turn in the spring which is bottomed against the base V-ring, and an opposed final turn which butts against the cylinder chamber wall. The final turn which butts against the base V-ring has been found to cause cocking and fracturing of the base V-ring due to the fact the same is formed of an elastomeric material. It has been found that once the base V-ring commences to cock, after prolonged usage, the points of cocking will utlimately fracture and this causes fluid to leak through the packing system and hence leak into the crank case housing. Once again, one feature of the present invention is to improve upon the packing system, which in combination with the other features described herein again prolong the useful life of the pump many times that normally experienced in the past.

Finally, it has been found to be beneficial to provide improved seals for not only the valve assemblies, but also the sealing system for the plunger arrangement within the cylindrical chamber in order to positively insure that lubricating fluid from the crank case housing will not leak into the wet part of the pump, and alternatively, that fluid from the wet part of the pump will not leak into the crank case housing. In the past, it has been found that the sealing arrangement employed around the plunger has been less than efficient, such that fluids will tend to leak and intermix in the crank case housing as well as in the wet end of the pump. The present invention again seeks to improve upon the sealing system employed, especially in the area around the plunger in order to positively eliminate the problem of the exchange of fluids therebetween.

OBJECTS AND ADVANTAGES

It is therefore the principal object of the invention to provide an improved high pressure pump which includes an improved valve assembly such that the entire valve assembly is formed of an integral single piece construction other than the valve cap which is intended to reciprocate within the valve and to rely upon the castings for tightening the valve assembly in position in order to eliminate the floating of the valve within the corresponding port.

A further object of the invention is to provide an improved high pressure pump of the type described wherein the plunger arrangement has been converted from a single unitary plunger arrangement to a two-piece plunger arrangement in order to permit the wet end of the plunger to be easily removed and replaced when replacement is warranted, thereby eliminating the need to disassemble the entire crank case housing, and at the same time, permit a variety of diametrically sized wet end plungers to be substituted such that a single pump may be accommodated to discharge water at a variety of fluid pressures.

In connection with the foregoing objects, it is yet a further object of the invention to provide a high pressure pump of the type described wherein an improvement has been effected to the packing system associated with the plunger arrangement in order to obviate and eliminate the problem of fluid leakage through the packing system due to the breakdown of the elastomeric base V-ring incorporated in the system, and to further improve upon the construction of the grease ring such that elastomeric washers may be eliminated from the packing system.

A further object of the invention is to provide a high pressure pump assembly wherein the crank case housing has been improved by modifying the interior configuration of the housing such that the drainage of the crank case is dependent not only upon the gravity flow of the lubricating fluid, but also due to the configuration of the bottom wall of the housing, the lubricating fluid as well as any sludge and other foreign matter will have a tendency to flow out of the crank case in order to minimize the build-up of sludge within the crank case housing.

Specifically, an object of the present invention is to provide a high pressure pump of the type having a rotatable crank shaft connected to moving a plunger through a suction stroke and a pressure stroke characterized by having a valve system wherein each of the valve assemblies includes a valve housing, the valve housing having a cup-shaped chamber surrounded by an apertured sidewall, an apertured top wall, and a defined open bottom wall, the valve housing further including a peripheral continuous flange carried on the bottom end thereof and extending for a short distance laterally outwardly from the valve housing, and having a continuous side edge and an outer surface thereof, the outer surface of the continuous flange provided with a continuous shoulder spaced a distance inwardly from the side edge and bounding the defined open bottom wall of the valve housing, the valve assembly being completed by a valve cap positioned in arrested arrangement within the valve housing to alternately open and close the defined open bottom wall in response to the movement of fluid therethrough, and wherein the valve housing including the cup-shaped chamber, the peripheral continuous flange, and the continuous shoulder are formed integrally as a one-piece construction.

In connection with the foregoing object, it is a further object of the invention to provide a high pressure pump of the type described which further includes an improved plunger arrangement wherein the plunger is formed by a crank case plunger section, having an inner end connected to the crank shaft, and an outer end including locking means associated therewith, and a second pump plunger section having an inner end including mating locking means for matingly lockingly engaging the outer end of the crank case plunger section, and an outer wet end intended to push the fluid to be introduced and discharged from the pump, such that the pump plunger section may be removed from the crank case plunger section without the need for disassembling the crank case housing in order to replace that portion of the plunger arrangement which experiences a greater amount of wear during usage.

A further feature of the invention is to provide an improved high pressure pump of the type described above, wherein a further improvement is provided in connection with the packing system by providing a base V-ring interposed between the spring tending to normally maintain the packing system in position within the cylindrical chamber carrying the plunger, and the stacked elastomeric packing rings whereby the base V-ring is formed of a solid, integral, non-resilient and metallic material thereby to eliminate the possibility of cocking and fracturing of the base V-ring portion of the packing system.

In connection with the foregoing object, it is yet a further object of the invention to further improve upon the packing system associated with the plunger arrangement by providing an improved grease ring which is formed of a thickened cross-sectional dimension thereby to eliminate the need for any elastomeric washers, and to further include a recessed groove along the inner surface of the grease ring which accommodates the provision of an O-ring therein in order to provide the necessary seal while at the same time eliminating the possibility of having the elastomeric gasket or seal fracture upon prolonged use.

Further features of the invention pertain to the particular arrangement of the elements and parts whereby the above-outlined and additional operating features thereof are attained.

The invention, both as to its organization and method of operation, together with further objects and advantages thereof, will thus be understood by reference to the following specification, taken in conjunction with the accompanying drawings.

BRIEF DESCRIPTION OF DRAWINGS

With reference to the drawings, the following figures are shown:

FIG. 1 is a perspective view of a typical high pressure pump relating to the present invention;

FIG. 4 is a front elevational view, in cross section, showing the positioning of the novel valve assemblies of the present invention within a two cylinder pump;

FIG. 5 is an exploded view showing the construction of the novel valve assembly of the present invention;

FIG. 6 is a perspective exploded view showing the improved packing system associated with the present invention;

FIG. 7 is a perspective, exploded view, showing the features of the novel plunger arrangement provided by the present invention;

SUMMARY OF THE INVENTION

In summary, the invention provides an improved high pressure pump of the type including a plunger arrangement adapted for reciprocating movement in a cylindrical chamber which operates to introduce a fluid into a suction chamber and to discharge the fluid from a discharge chamber at a high pressure. The improvement resides in the construction of an improved valve assembly for use in the suction and discharge chambers which provides a basic one-piece construction valve assembly which further includes in captured arrangement the valve cap which is designed to alternately open and close the valve opening. In addition, the invention provides an improved plunger arrangement whereby the plunger is formed of a two-part construction including a crank case plunger section attached to the crank shaft and substantially contained within the crank case housing, and a pump plunger section which is lockingly engaged with the crank case plunger section and extends transversely through a cylindrical chamber into the pump portion of the assembly, such that the pump plunger section may be removed from the crank case plunger section for replacement purposes without disassembling the crank case housing.

The invention further provides an improved packing system wherein the grease ring has been modified in construction to eliminate any thermoplastic resin washers and to incorporate an O-ring in lieu thereof, and wherein the base V-ring is formed as a solid integral non-resilient metallic ring. Furthermore, an improved double lip gasket is provided in circumferential arrangement about the crank case plunger section of the plunger arrangement in order to improve upon the seal to prevent an exchange of fluids between the crank case housing and the wet pump portion of the assembly.

Finally, the pump is further improved in that the crank case housing is provided with a V-shaped sloped bottom wall with a rear wall drain hole and drain plug such that the lubricating fluid to be drained from the crank case housing will tend to flow not only by gravity, but also due to the contour of the bottom wall and to carry with it any sludge or other foreign matter existing within the crank case housing.

DETAILED DESCRIPTION OF THE DRAWINGS

Figures 2, 3:
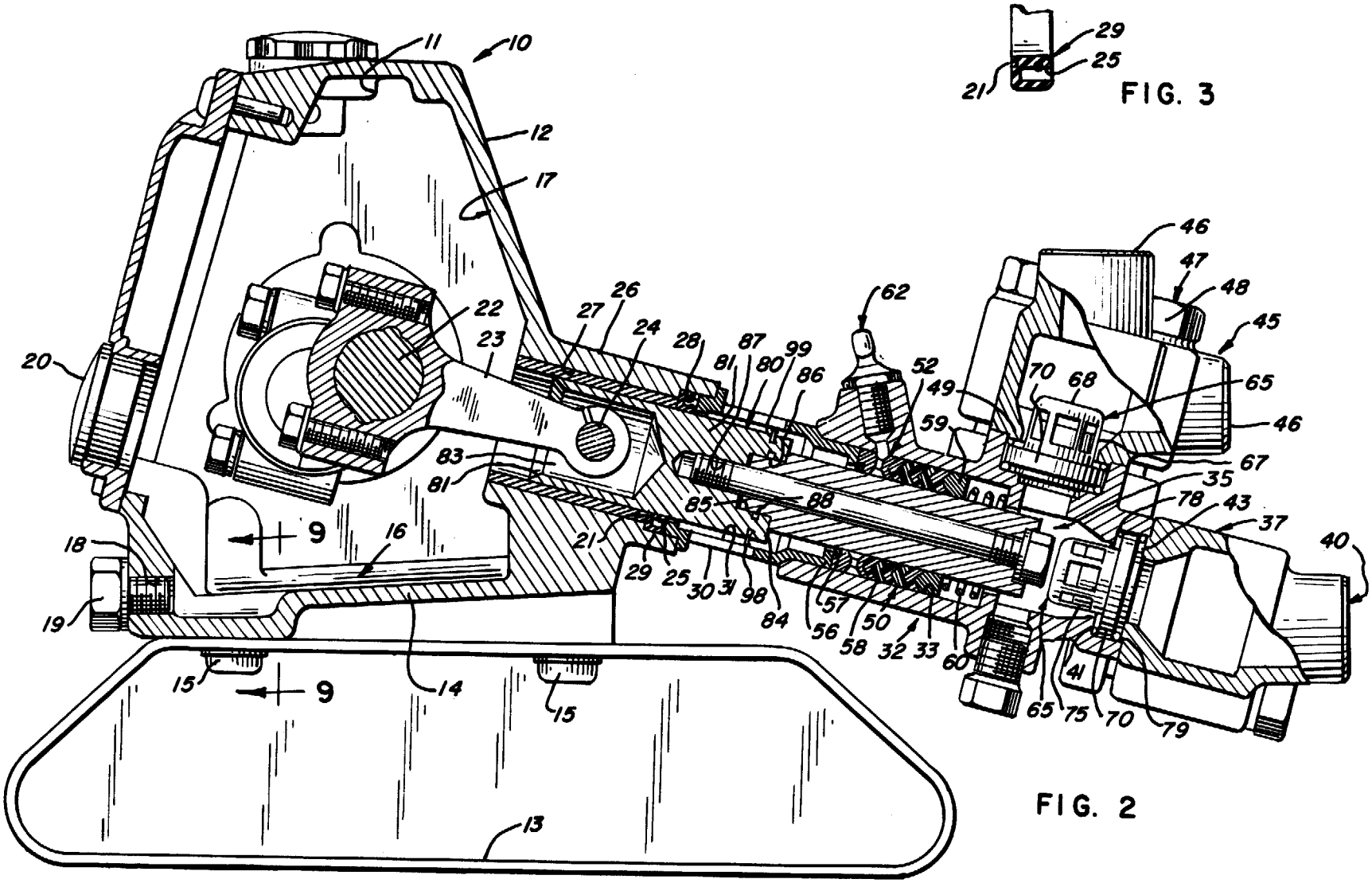
FIG. 2 is a side elevational view, in cross section, showing the improved high pressure pump of the present invention and all of the features attendant thereto.
FIG. 3 is a side elevational view in cross section, showing a novel protective gasket associated with the plunger arrangement which facilitates the invention of interchanging fluids between the crank case and the pump.

With specific reference to FIGS. 1 and 2 of the drawings, there is shown a high pressure pump of the reciprocating plunger type, generally referred to by the numeral 10. The pump 10 has a crank case housing 12 which is supported by a mounting rail 13 and held by fasteners 15. The crank case housing 12 defines a chamber 17 in which lubricating oil is delivered through an oil fill 11. A drain port 18 is enclosed by means of a drain plug 19 which is screw threadedly fitted into the port 18 in the manner shown in FIG. 2. The crank case housing 12 also is shown to include a window gauge 20 for permitting the monitoring of the oil levels within the chamber 17.

The crank case housing 12 contains a crank shaft 22 to which is joined the connecting rods 23, which are in turn connected to the plunger arrangement 80 by connecting pin 24. The inner end of the pump 10 is provided with a housing extension 26 which has a cylindrical chamber 27 formed therein. The outer end of the cylindrical chamber 27 includes an annular recess 28 which accommodates a double lip seal gasket 29 which will be more fully described hereinafter.

A spacer element 30 separates the housing extension 26 from the pump housing 32. The pump housing 32 is shown to include a cylindrical chamber 33 which mates with a similar cylindrical chamber 31 formed in the spacer element 30. It will be observed that the entire plunger chamber is formed by the cylindrical chamber 27 formed in the crank case housing 12 as well as the cylindrical chamber 31 formed in the spacer element 30, and the cylindrical chamber 33 formed in the pump housing 32. For the sake of convenience, the plunger chamber will be generally referred to by the numeral 35. It will be appreciated that the plunger arrangement 80 reciprocates in response to the movement of the rotating crank shaft 22 during the operation of the pump 10.

The pump housing 32 is shown to include a suction housing 37 which is clamped to crank case housing 12 by bolts 38, which are in turn held in position by nuts 39. The suction housing 37 is shown to include a suction port 40, and down line interiorly of the port 40 there is formed an annular shoulder 41.

The top portion of the pump housing 32 is shown to include a discharge housing 45 which similarly includes a discharge port 46 which fluid passing through the pump 10 will be ejected by operation of the pump. The discharge housing 45 is held to the pump housing 32 by fasteners 47 which consist of threaded bolts held in position by nuts 48. As shown in FIG. 2 of the drawings, the discharge housing 45 is shown to include a distinct annular step 49 which functions to hold the corresponding valve assembly firmly in position as will be more fully described hereinafter.

Simiarly, the suction housing 37 is shown to include a distinct annular step 43 which functions to hold the corresponding valve assembly securely in position, again as will be more fully described hereinafter.

As further shown in FIGS. 2 and 6 of the drawings, the pump 10 is shown to be provided with a packing system generally referred to by the numeral 50 which is formed by an annular grease ring 52 which is formed by a thickened inner annular wall 53 and a circumferentially grooved surface 54. The grooved surface 54 includes a plurality of grease apertures 55 which function to permit grease to enter into the interior portion of the packing for the purpose of lubricating the plunger arrangement 80 as will be more fully described hereinafter. The inner thickened wall section 53 of the grease ring 52 includes a stepped section 56 (FIG. 2), which accommodates an O-ring 57 positioned therein. It will be appreciated that by this construction, the necessity for providing any type of elastomeric seal ring or washer as heretofore been provided in the prior art has been totally eliminated thereby to improve the seal effected between the grease ring 52 and a corresponding wall provided by the spacer element 30.

The packing system 50 further includes a plurality of flexible annular V-packing rings 58 which are grouped together in stacking arrangement. As is customary with these types of packing rings, the inner and outer surfaces are contoured such that one packing 58 is permitted stacking arrangement with the next adjacent packing 58. It will also be appreciated that the packing rings 58 butt against the grease ring 52 at the inner end of the stack, and at the outer end of the stack of V-packing rings 58, the same butt against a base V-ring 59.

The base ring 59 is shown to butt against coil spring 60 which is interposed between the base V-ring 59 and the annular shoulder 41 formed in the plunger chamber 35. As has been indicated previously, the coil spring 60 includes a final turn at the inner end thereof which butts against the flat surface of the base V-ring 59. The improvement of the present packing system 50 resides in the fact that the base V-ring 59 is now formed of a non-resilient metallic material, such as brass, in order to resist the stresses placed upon the base V-ring 59 by the final turn of the spring 60. In this manner, any tendency to warp or crack due to the high pressures involved is totally resisted such that leaks in the packing system 50 are minimized, if not eliminated.

As is further shown in FIG. 2 of the drawings, the packing system 50 may be tightly positioned within the plunger chamber 35 by tightening the nuts 39 carried on the bolts 38. It will be appreciated from FIGS. 1 and 2 of the drawings that as the nuts 39 are tightened down, the pump housing 32 is drawn down against the spacer element 30 causing the coil springs 60 to further compress and further force the entire packing system 50 into a tight arrangement within the plunger chamber 35. It will further be noted that the packing system 50 is located immediately beneath and underlies a greasing device such as a zerk fitting assembly 62 which functions to permit the operator to introduce grease into the packing system 50, as is known in the art.

As is particularly shown in FIGS. 2 and 5 of the drawings, an improved valve assembly, generally referred to by the numeral 65 is illustrated. The valve assembly 65 is shown to be formed by cup-shaped valve housing 66 which includes an apertured sidewall 67 and an apertured top wall 68. The bottom portion of the valve housing 66 is shown to include an outwardly flanged rim 69 which coacts with the valve seat section 70 of the valve assembly 65. The valve seat section 70 is formed by a metallic main body portion 71 having an inner stepped wall 72 and an outer wall 73 which includes an annular groove 74 formed therein. As particularly shown in FIG. 4 of the drawings, the flanged rim 69 formed as part of the valve housing 66 is fixedly press fitted or otherwise secured within the inner stepped wall 72 of the valve seat section 70 thereby to form an integral valve assembly 65 which is basically of one piece construction. During the manufacturing process, the valve is provided with a valve cap 75 which is positioned within the valve housing 66 and interposed between the apertured top wall 68 thereof and the inner portion of the inner stepped wall 72 of the valve seat section 70. As shown in FIG. 5, the central portion of the valve seat section 70 includes a central main aperture 76, and it will be appreciated that the valve cap 75 seats against the central main aperture 76 to alternately open and close the valve assembly 65. The valve cap 75 is normally urged into a closing posture by means of coil spring 77 which is shown to be interposed between the valve cap 75 and the apertured top wall 68 of the valve housing 66. When the valve assembly 65 is positioned within the appropriate port, a pair of O-rings 78 and 79 respectively are positioned on top and beneath the valve assembly to effectively seal the valve assembly 65 into position within the appropriate port. This arrangement is clearly shown in FIG. 4 of the drawings.

It will be appreciated from the above description that the valve assembly 65 as set forth herein provides an improved valve assembly for the reason that the requirement for any elastomeric seal ring in order to hold the various parts of the valve assembly together has been totally eliminated.

In addition, the elastomeric seal rings heretofore known in the art have traditionally been utilized for the purpose of seating the valve assembly into position within the corresponding port. Generally, the outer diameter of the seal ring has been sized such that the seal ring will frictionally fit within the corresponding port and when the appropriate housing such as the suction housing or the discharge housing are tightened down over the valve assemblies, a reliance has been placed upon the characteristics of the elastomeric seal ring for holding the valve assembly in secure position within the port. However, as was indicated previously, it has been found that with prolonged use, these elastomeric seal rings have a tendency to cock or extrude out of the related port thereby causing a floating of the valve assembly within the corresponding port. This action, in turn, causes the pump to leak. It will therefore be appreciated that by providing a valve assembly which is essentially formed as an integral assembly of which the main valve seat casting seats against the corresponding pump casting with metal to metal contact, and including the O-ring as the sealing means, the problem associated with the cocking or extruding of the seal ring has been eliminated.

It will further be appreciated that during the manufacture of the valve assembly 65 as described above, while the valve housing 66 and valve seat section 70 may be initially formed as two pieces, the flanged rim 69 formed in the valve housing 66 is dimensionally sized such that the same is press fitted or otherwise fixedly secured within the inner stepped wall 72 of the valve seat section 70. Once these two pieces have been assembled, they essentially form an integral assembly and cannot be removed such that an effective one piece construction is ultimately achieved. It will be appreciated that this type of manufacture is necessary if in fact valve cap 75 and the coil spring 77 are to be inserted within the inner confines of the valve housing 66 to construct an effective valve assembly 65.

Figure 8:
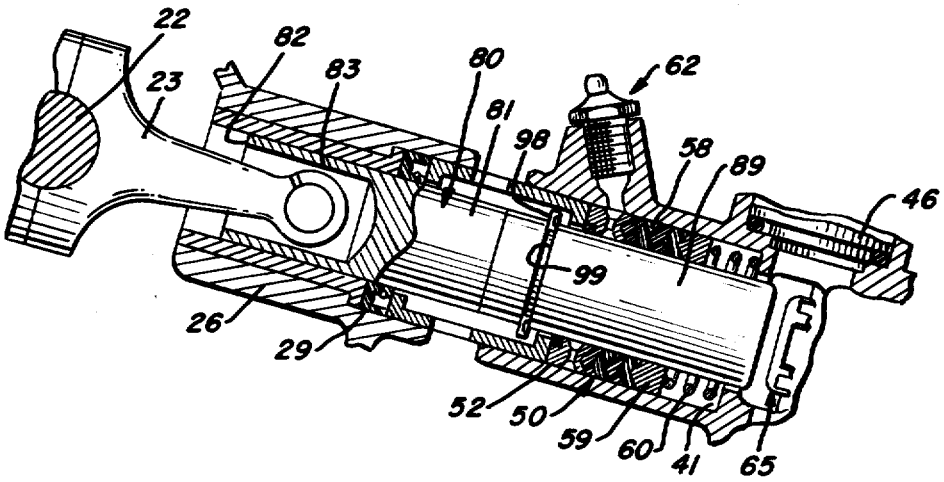
FIG. 8 is a side elevational view, in cross section, showing the features of the plunger arrangement in position in the cylindrical chamber, as well as the relationship thereof with the packing system herein and the protective gasket associated therewith.

As further shown in FIGS. 2, 7 and 8 of the drawings, another feature of the high pressure pump of the present invention relating to the plunger arrangement 80 is illustrated. As was indicated previously, the typical pumps of the prior art generally provide a single cylindrical plunger of the type shown in Pat. No. 3,849,032. However, it has been found that when the plunger must be replaced due to the wearing of the surface thereof, it has been necessary to completely dismantle the crank case housing in order to disconnect the plunger from the crank shaft. The present invention seeks to obviate this difficulty in the manner described hereinbelow.

As particularly shown in FIG. 7 of the drawings, the plunger arrangement 80 is shown to be formed by the crank case plunger section 81 which includes an inner end 82 having a transverse apertured section 83 associated therewith for connection to the crank shaft. The forward end 84 of the crank shaft plunger section 81 is provided with a centrally positioned annular recess 85, and further including a interiorly positioned circumferential groove 86 (FIG. 2). Extending inwardly from the annular recess 85 is a threaded core section 87 which accommodates the locking means as will be more fully described below.

As is evident from FIGS. 2 and 8 of the drawings, the crank case plunger section 81 is fixedly secured to the crank shaft 22 by means of the connecting rod 23 which, in turn, is held in position by the connecting pin 24 which is inserted through the transverse apertured section 83 thereof. It will further be observed that the forward end 84 of the crank case plunger section 81 extends into the cylindrical chamber 31 of the spacer element 30 and hence, projects outwardly from the crank case housing 12.

The plunger arrangement is essentially completed by a pump plunger section 89 which includes an extension rod 91 formed at its inner end, the extension rod 91 having an outside diameter slightly less than the inside diameter of the annular recess 85 formed in the crank case plunger section 81. The forward end 92 of the pump plunger section 89 includes a central recess 93 and is dimensionally sized to accommodate the locking means for lockingly engaging the crank case plunger section 81 to the pump plunger section 89. As is evident from FIG. 7 of the drawings, both the crank case plunger section 81 and the pump plunger section 89 are centrally cored as generally illustrated at 94, thereby to accommodate the insertion therethrough of a threaded bolt 95.

As was indicated previously, the crank case plunger section 81 is provided with a threaded core section 87, and it will be appreciated that one end of the threaded bolt 95, when inserted through the central core sections 94 will fit within the threaded core section 87 and screw threadedly positioned therein. The upper end of the threaded bolt 95 will then accommodate lock washer 96 and nut 97 with the nut 97 being accommodated within the central recess 93 at the forward end of the pump plunger section 89.

It will be apreciated that by virtue of this construction, in order to change and replace the plunger arrangement 80, the operator need only dismantle the pump housing 32 in order to expose the pump plunger section 89 thereof. The operator may then unscrew the nut 97 carried on the threaded bolt 95 and thereby remove the pump plunger section 89 therefrom. This piece may then be easily replaced such that the pump may then be placed back in operation. It will therefore be appreciated that the repairs to the plunger arrangement 80 may be easily effected within a minimum period of time and at a minimum cost of labor, and also permitting the operator minimal down time of his equipment.

Another advantage to be achieved by providing a two part plunger arrangement 80 is the fact that the pump plunger section 89 may assume a variety of diametric sizings. As shown in FIG. 7 of the drawings, the typical arrangement is to provide a plunger arrangement 80 wherein the crank case plunger section 81 and pump plunger section 89 are of the same diameter. However, as shown in FIG. 2 of the drawings, the pump plunger section 89 may be varied to a smaller diameter when replacing the same. The significance of this adaptability resides in the fact that a single high pressure pump may be adapted to vary the discharge flow and pressure of the fluid being discharged through the discharge housing 45. It will be appreciated that where a smaller diameter pump plunger section 89 is employed, less water will be pushed, but at a higher or greater pressure in terms of pounds per square inch. Hence, for example, if a given high pressure pump is designed to push six gallons of a fluid per minute, and the pump plunger section 89 is replaced with a smaller diameter section, it is possible to push a smaller amount, such as three gallons per minute of water, but the outgoing pressure of the fluid exiting through the discharge housing 45 may be at double the pressure in terms of pounds per square inch. It is therefore possible to achieve the same ultimate result with a lesser quantity of the fluid hence conserving the pump fluid. It will be appreciated that where the operation involved is, for example, a car wash assembly, and a high pressure pump is being employed to pump water and soap onto the vehicle to be cleaned, and should there be a problem with water shortages, the high pressure pump can be converted to push less water per unit of time but at a greater PSI pressure so that the same cleaning impact effect against the body of the vehicle will be achieved. It will be appreciated that this adaptation can be effected in the manner hereinabove with a minimum of effort without the requirement of completely dismantling the pump and the crank case housing in order to effect this change.

The plunger arrangement 80 is shown to be completed by the provision of a protector gasket 98 which is carried in a circumferential groove 99 formed in the body of the pump plunger section 89. The protector gasket 98 has the effect of further insuring that the pump fluid contained within the pump housing 32 will not intermix with the lubricating fluid contained in the crank case chamber 17 during the operation of the pump. In this connection, the provision of a double lip seal gasket 29 heretofore described further insures against the intermixture of such fluids. In the prior art high pressure pumps, an O-ring or other sealing gasket has usually been employed in riding engagement overriding the crank case plunger section 81 of the plunger. During the reciprocation of the plunger arrangement 80, it has been found that the O-ring or other sealing gasket having two flat surfaces will ultimately cock or extrude within the plunger chamber 35 and may ultimately leak fluids either from the crank case chamber 17 into the pump housing 32 or in the reverse direction. The double lip seal gasket 29 provided herein includes a forward lipped portion 21 which is resilient and yieldable, as well as a rearward lipped portion 25 which is similarly resilient and yieldable. It has been found that this construction permits the gasket 29 to move with the plunger arrangement 80 while at the same time eliminating any extruding or cocking of the gasket during the performance of the pump 10. Hence, there is a greater degree of insurability that lubricating fluids from the crank case chamber 17 will not intermix with any fluids from the pump housing 32.

The interconnection of the two sections of the plunger arrangement 80 is further provided with an O-ring 88 which is situated in the circumferential groove 86 formed in the annular recess 85 of the crank case plunger section 81. This eliminates the possibility of fluid entering through the central core of the plunger arrangement 80 and exiting into the crank case housing 12.

As will be further be appreciated from a view of FIGS. 2 and 4 of the drawings, the valve assemblies 65 which are positioned within the corresponding suction housing 37 and discharge housing 45 are in reversed position. In other words, during the suction stroke of the plunger arrangement 80, the valve cap 75 within the valve assembly 65 interposed in the path of the suction port 40 will open, while at the same time, the valve cap 75 within the valve assembly 65 positioned in the path of the discharge port 46 will close. In this manner, fluid such as water or any other fluid to be pumped is drawn into the suction housing 37, until the plunger arrangement 80 is pushed through a pressure stroke by the crank shaft 22. During the pressure stroke of the plunger arrangement 80, the corresponding valve assembly 65 will simply reverse such that the valve assembly in the path of the suction port 40 will close and the valve assembly 65 in the path of the discharge port 46 will open such that fluid will be ejected through the discharge port 46 in a manner customarily known in the art. The improved packing system 50 insures that the component parts of the packing system will not break down with prolonged usage thereby to insure the efficiency of the subject pump over a long period of time. It has been found that with the novel construction of the valve assemblies as set forth herein, the useful life of the valve assemblies has been increased approximately twenty fold over the life of valve assemblies heretofore known in the art.

Overall, the useful life of the entire high pressure pump assembly of the present invention has been increased a significant degree over prior art types of similar pumps by the improvements as set forth herein. As was indicated hereinabove, the valve assemblies have been improved by providing a single piece construction as opposed to a multiple piece construction, and in addition to this feature, the provision of a two piece plunger arrangement has similarly had a marked effect on the useful life of the pump. The improvements relating to the improved packing system as well as to the improved sealing and gasket system has similarly had a significant impact on the useful like of such pumps especially when it is considered that pumps of this type are utilized under high pressure situations.

Figure 9:
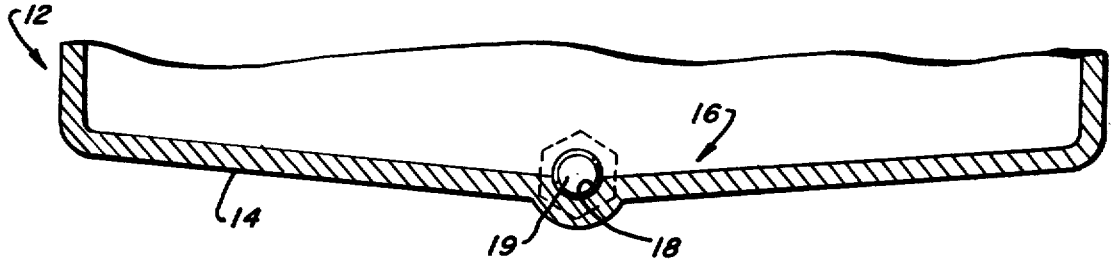
FIG. 9 is a rear elevational view, in cut-away cross section, showing the configuration of the crank case housing associated with the high pressure pump of the present invention.

As was also indicated previously, an additional improvement has been effected to the pump of the present invention in terms of the configuration of the crank case housing 12. As shown in FIG. 9 of the drawings, the bottom wall 14 of the crank case housing 12 is shown to assume a V-shaped configuration generally indicated by the numeral 16. In this connection, it will be observed that the V-shaped configuration 16 extends from a high point along the sidewalls of the housing 12 downwardly to the apex or middle portion of the V-shaped configuration 16 along the center line of the housing 12. In addition, and as will be observed in FIG. 2 of the drawings, the bottom wall 14 of the housing 12 is pitched from a high point at the inner end of the housing 12 to a low point adjacent the outer wall of the housing 12 such that there is an overall top to bottom pitch in the direction of the oil entry port 18. This feature has a direct impact on the ability to effectively drain the used lubricating fluid from the crank case chamber 17 such that any sludge or any foreign matter existing in the lubricating fluid will similarly be induced to exit through the oil entry port 18. Hence, a more efficient and positive draining of the crank case chamber 17 is effected. This feature, in addition to those features set forth above, also has an impact on the useful life of the overall pump 10 since there is less wearing of the parts in the crank case housing 12 due to the fact that the lubricating fluid, when replaced, will have a tendency to include less sludge and foreign matter as heretofore permissible with presently available devices.

It will be appreciated from the above description that by virtue of the present invention, there has been provided an improved high pressure pump of the type having reciprocating plungers formed therein, whereby the useful life of the pump has been prolonged significantly over what has been feasible to date. In addition, by providing an improved valve assembly for such pumps, the problem of leakage through defective valves has been further minimized. Furthermore, the provision of a two-piece plunger arrangement has not only minimized the cost and time required for replacing a worn or damaged plunger, but in addition, the operator now has a significant degree of versatility in terms of converting a single pump to multiple gallonage discharge rates while still performing the same function. The improvement in the construction of the housing, especially as that construction relates to the configuration of the bottom wall insures that a more efficient drainage of the crank case chamber can be accomplished such that again, there is a minimal wearing of the parts in the crank case chamber with usage. It will further be appreciated that by virtue of the improvements set forth herein, the overall cost of not only manufacture, but also operation and maintenance of such high pressure pumps has been significantly improved.

While there has been described what is at present considered to be the preferred embodiments of the invention, it will be understood that various modificiations may be made therein and it is intended to cover in the appended claims all such modificiations as fall within the true spirit and scope of the invention.

What is claimed is:

1. In a high pressure pump of the type having a rotatable crank shaft connected to and moving a plunger through a suction stroke and a pressure stroke to urge fluid from the suction chamber into the plunger chamber of the pump and then urge the fluid under pressure through a discharge chamber and out of the pump, and further characterized by having a valve system including at least a first valve assembly interposed between the suction chamber and plunger chamber and operationally functioning to open and admit fluid into the plunger chamber during a suction stroke of the plunger, and at least a second valve assembly interposed between the plunger chamber and the discharge chamber and operationally reversed relative to the first valve assembly such that the second valve assembly closes when the first valve assembly is open, and the opening and closing of the first and second valve assemblies is reversed during the pressure stroke of the plunger, the improvement comprising an improved valve system wherein each of said valve assemblies includes a valve housing, said valve housing having a cup-shaped chamber surrounded by an apertured sidewall, an apertured top wall, and a defined open bottom wall, said valve housing further including a peripheral continuous flange carried on the bottom end thereof and extending for a short distance laterally outwardly from said valve housing, a valve seat section formed by a main body portion having a central aperture therethrough and having an inner stepped wall and a spaced outer wall which includes an annular groove formed therein, said continuous peripheral flange being sized to seat and be fixedly secured within the space between said inner stepped wall thereby to form an integral valve assembly, said valve assembly being completed by a valve cap positioned in arrested arrangement within said valve housing and adapted for reciprocating movement therein such that said valve cap alternately opens and closes said central aperture in response to the movement of fluid therethrough, and said valve housing including said cup-shaped chamber, said peripheral continuous flange and said valve seat section being formed such that said valve assembly is an integral assembly.

2. The high pressure pump as set forth in claim 1 above, which further includes biasing means interposed between said valve cap and said top wall of said housing such that said valve cap is normally biasingly urged into a seated position for closing said defined open bottom wall of said valve assembly.

3. The high pressure pump as set forth in claim 2 above, wherein said biasing means is formed by a coil spring biased between the apertured top wall of said valve housing and said valve cap.

4. A high pressure pump of the type having a rotatable crank shaft connected to and moving a plunger through a suction stroke and a pressure stroke to urge fluid from the suction chamber into the plunger chamber of the pump and then urge the fluid under pressure through a discharge chamber and out of the pump and further characterized by having a valve system including at least a first valve assembly interposed between the suction chamber and plunger chamber and operationally functioning to open and admit fluid into the plunger chamber during the suction stroke of the plunger, and at least a second valve assembly interposed between the plunger chamber and the discharge chamber and operationally reversed relative to the first valve assembly such that the second valve assembly closes when the first valve assembly is open, and the opening and closing of the first and second valve assemblies is reversed during the pressure stroke of the plunger, comprising, an improved valve system wherein each of the valve assemblies is formed by a valve housing, said valve housing having a cup-shaped chamber surrounded by an apertured sidewall, an apertured top wall and a defined open bottom wall, said valve housing further including a peripheral continuous flange carried on the bottom end thereof and extending for a short distance laterally outwardly from said valve housing, a valve seat section formed by a main body portion having a central aperture therethrough and having an inner stepped wall and an outer wall which includes an annular groove formed therein, said continuous peripheral flange being sized to seat and be fixedly secured within the space between said inner stepped wall and said outer wall thereby to form an integral valve assembly, said valve assembly being completed by a valve cap positioned in arrested arrangement within said valve housing and adapted for reciprocating movement therein such that said valve cap alternately opens and closes said central aperture in response to the movement of fluid therethrough, said valve housing including a cup-shaped chamber, said peripheral continuous flange and said valve seat section being formed such that said valve assembly is an integral assembly, said pump further including an improved plunger assembly, said plunger assembly including a crank case plunger section having an inner end for connection to the crank shaft and an outer end including locking means associated therewith, an outer pump plunger section having an inner end including mating lock means for matingly nesting with and engaging said lock means on said crank case plunger section and an opposed pusher end of said pump plunger section, said crank case plunger section and said pump plunger section being removably engageable one with respect to the other such that said pump plunger section may be removed from said crank case plunger section to replace the same, and means associated with said plunger arrangement for lockingly engaging said crank case plunger section and said pump plunger section in locked relationship during use.

5. The high pressure pump as set forth in claim 4 above, wherein said pump is provided with a cylindrical chamber for accommodating the reciprocation of said plunger therein, said cylindrical chamber being provided with an improved packing system for effecting the distribution of grease about the periphery of said plunger arrangement, said improved packing system including an enlarged grease ring provided with a seating surface including a stepped section to accommodate an O-ring therein, and a packing ring butting surface along the opposed wall thereof, a plurality of annular packing rings positioned in stacked arrangement one with respect to the other, said stack of packing rings supported against the packing ring butting surface of said grease ring at one end, and having a V-ring bearing surface at the opposed end of said stack, a base V-ring having an inner surface for bearing against said V-ring bearing surface of said stack of packing rings and a spring support surface on the opposed surface thereof, said base V-ring being formed of a solid non-resilient metallic material such that said base V-ring resists distortion in any direction, and said packing system being completed by a spring member bearing against said opposed surface of said base V-ring at its one end, and bearing against the end of the cylindrical chamber at its opposed end, whereby said packing system is accommodated within said cylindrical chamber and overrides said pump plunger section of said plunger arrangement in order to provide an improved greasing function as well as to eliminate the cocking and extruding of said packing system during the reciprocation of said plunger arrangement.

6. The high pressure pump as set forth in claim 4 above, wherein said crank shaft plunger section includes an annular recess in the outer end portion thereof and a threaded channel extending downwardly from said annular recess, said pump plunger section being provided with an extension portion at the inner end thereof, said extension portion being sized to nest within said annular recess of said crank case plunger section, said crank case plunger section and said pump plunger section each having a central core extending transversely therethrough, and said locking means for lockingly engaging said pump plunger section to said crank case plunger section including a threaded shaft having threaded portions at the opposed ends thereof such that the inner threaded portion threadingly engages said threaded channel of said crank case plunger section while the threaded portion of the opposed end thereof adjacent the outer end of said pump plunger section is adapted to accommodate a threaded nut such that said crank case plunger section and pump plunger section may be lockingly engaged together to function as a unitary element while permitting the removable engagement of said pump plunger section with said crank case plunger section by removing said threaded nut therefrom.

7. A high pressure pump as set forth in claim 6 above, wherein said plunger arrangement is further provided with an annular groove interposed between the opposed ends thereof, said annular groove carrying a protector seal therein, said protector seal functioning to prevent the interchange of fluids from said crank case and from said suction and discharge chambers of said pump.

8. The high pressure pump as set forth in claim 4 above, wherein said pump further is provided with a crank case housing, said crank case housing defining a crank case chamber surrounded by sidewalls, a top wall, and a bottom wall, said bottom wall of said crank case chamber having a V-shaped configuration side to side, and having a definite angled slope, said slope being pitched from a high end at the pump end of said crank case chamber and a low end at the rear end of said crank case chamber, said crank case housing being provided with a drain plug being positioned at the lowest point of said backwall of said housing and in alignment with the apex of said V-shaped bottom wall, whereby lubricating fluid contained within said crank case chamber may be drained therefrom by removing said plug from said back wall of said crank case chamber and permitting the lubricating fluid to flow through said drain hole by gravity due to the contour of said V-shaped bottom wall as well as the slope of the bottom wall from pump side to back side thereof.

9. The high pressure pump as set forth in claim 6 above, wherein said annular recess of said crank case plunger section is further provided with a peripheral groove positioned interiorly thereof and circumferentially arranged, said groove accommodating an O-ring seal therein, whereby said O-ring functions to seal said pump plunger section within said crank case plunger section when in locked position therein.

* * * * *